US008955245B2

(12) United States Patent
Chvala

(10) Patent No.: US 8,955,245 B2
(45) Date of Patent: Feb. 17, 2015

(54) ADJUSTABLE STOCK FOR A FIREARM

(71) Applicant: Advanced Technology International USA, LLC, Milwaukee, WI (US)

(72) Inventor: John R. Chvala, Grafton, WI (US)

(73) Assignee: ATI IP, LLC, Cedarburg, WI (US)

( * ) Notice: Subject to any disclaimer, the term of this patent is extended or adjusted under 35 U.S.C. 154(b) by 7 days.

(21) Appl. No.: 13/832,987

(22) Filed: Mar. 15, 2013

(65) Prior Publication Data

US 2014/0259848 A1 Sep. 18, 2014

(51) Int. Cl.
*F41C 23/00* (2006.01)
*F41C 23/14* (2006.01)

(52) U.S. Cl.
CPC ..... *F41C 23/14* (2013.01)
USPC ..... 42/73; 42/71.01; 42/74; 42/1.06

(58) Field of Classification Search
USPC ..... 42/73, 71.01, 74, 1.06
See application file for complete search history.

(56) References Cited

U.S. PATENT DOCUMENTS

| | | | | | |
|---|---|---|---|---|---|
| 717,011 | A | * | 12/1902 | Marsland et al. | 42/71.01 |
| 1,651,299 | A | * | 11/1927 | Stansel | 42/73 |
| 3,348,328 | A | * | 10/1967 | Roy | 42/73 |
| 3,604,138 | A | * | 9/1971 | Wilson | 42/74 |
| 3,710,496 | A | * | 1/1973 | Packmayr et al. | 42/71.01 |
| 4,122,623 | A | * | 10/1978 | Stice | 42/73 |
| 4,663,877 | A | * | 5/1987 | Bragg | 42/74 |
| 5,031,348 | A | * | 7/1991 | Carey | 42/74 |
| 5,235,764 | A | * | 8/1993 | Perazzi | 42/73 |
| 5,392,553 | A | * | 2/1995 | Carey | 42/73 |
| 5,410,833 | A | * | 5/1995 | Paterson | 42/73 |
| 5,970,642 | A | * | 10/1999 | Martin | 42/73 |
| 6,032,397 | A | * | 3/2000 | Iannetta | 42/73 |
| 6,651,371 | B2 | * | 11/2003 | Fitzpatrick et al. | 42/72 |
| 6,662,485 | B2 | * | 12/2003 | Kay | 42/75.03 |
| 6,874,267 | B2 | * | 4/2005 | Fitzpatrick et al. | 42/72 |
| 7,152,355 | B2 | * | 12/2006 | Fitzpatrick et al. | 42/73 |
| 7,162,822 | B1 | * | 1/2007 | Heayn et al. | 42/73 |
| 7,640,688 | B2 | * | 1/2010 | Oz | 42/73 |
| 7,673,413 | B2 | * | 3/2010 | Bentley | 42/75.03 |
| 7,762,018 | B1 | * | 7/2010 | Fitzpatrick et al. | 42/73 |
| 7,793,453 | B1 | * | 9/2010 | Sewell et al. | 42/73 |
| 7,802,392 | B2 | * | 9/2010 | Peterson et al. | 42/75.03 |
| 7,805,873 | B2 | * | 10/2010 | Bentley | 42/74 |
| 7,810,270 | B2 | * | 10/2010 | Fitzpatrick et al. | 42/73 |
| 7,823,313 | B2 | * | 11/2010 | Faifer | 42/74 |
| 7,827,721 | B2 | * | 11/2010 | Griffin | 42/73 |
| 7,849,626 | B2 | * | 12/2010 | Fluhr | 42/73 |
| 7,930,849 | B2 | * | 4/2011 | Abraham et al. | 42/73 |
| D639,891 | S | | 6/2011 | Chvala | |
| 7,966,760 | B2 | * | 6/2011 | Fitzpatrick et al. | 42/72 |

(Continued)

*Primary Examiner* — Michelle R Clement
(74) *Attorney, Agent, or Firm* — Andrus Intellectual Property Law, LLP

(57) ABSTRACT

An adjustable stock and cheek rest assembly for a firearm includes a buffer tube extending rearwardly from the firearm at an angle relative to the firearm receiver. A stock is slidably mounted on the buffer tube, and a cheek rest is disposed in overlying relationship to the stock. A cheek rest adjustment arrangement is connected between the stock and the cheek rest, and is provided with a movable linkage for enabling vertical movement of the cheek rest relative to the stock as the stock moves along the angled buffer tube. A movable member provided with locking structure is mounted on the stock for selective engagement with lock receiving structure on the buffer tube for locking the stock in various axial adjustment positions along the buffer tube.

19 Claims, 8 Drawing Sheets

(56) References Cited

U.S. PATENT DOCUMENTS

| | | | | |
|---|---|---|---|---|
| 7,966,761 | B1 * | 6/2011 | Kuczynko et al. | 42/73 |
| 7,984,580 | B1 * | 7/2011 | Giauque et al. | 42/73 |
| 8,051,593 | B2 * | 11/2011 | Vesligai | 42/73 |
| 8,087,193 | B2 * | 1/2012 | Kincel | 42/74 |
| 8,127,483 | B2 * | 3/2012 | Kincel | 42/73 |
| 8,186,090 | B1 * | 5/2012 | Chiarolanza et al. | 42/73 |
| 8,286,382 | B2 * | 10/2012 | Vesligai | 42/75.03 |
| 8,327,569 | B2 * | 12/2012 | Kincel | 42/73 |
| 8,341,868 | B2 * | 1/2013 | Zusman | 42/73 |
| 8,381,427 | B2 * | 2/2013 | Nill | 42/73 |
| 8,387,298 | B2 * | 3/2013 | Kincel | 42/74 |
| 8,397,414 | B2 * | 3/2013 | Walters | 42/73 |
| 8,434,252 | B2 * | 5/2013 | Holmberg | 42/1.06 |
| 8,453,365 | B1 * | 6/2013 | Ballard | 42/73 |
| 8,474,169 | B2 * | 7/2013 | Cottle et al. | 42/73 |
| 8,607,687 | B2 * | 12/2013 | Cottle | 89/140 |
| 8,631,601 | B2 * | 1/2014 | Langevin et al. | 42/73 |
| 2003/0140541 | A1 * | 7/2003 | Kay | 42/72 |
| 2007/0101631 | A1 * | 5/2007 | Bentley | 42/74 |
| 2007/0289190 | A1 * | 12/2007 | Oz | 42/73 |
| 2008/0028662 | A1 * | 2/2008 | Abraham et al. | 42/73 |
| 2008/0110074 | A1 * | 5/2008 | Bucholtz et al. | 42/1.06 |
| 2008/0236017 | A1 * | 10/2008 | Fitzpatrick et al. | 42/73 |
| 2010/0132240 | A1 * | 6/2010 | Webber et al. | 42/75.03 |
| 2010/0205846 | A1 * | 8/2010 | Fitzpatrick et al. | 42/73 |
| 2010/0212205 | A1 * | 8/2010 | Nill | 42/73 |
| 2010/0242333 | A1 * | 9/2010 | Kincel | 42/73 |
| 2010/0251587 | A1 * | 10/2010 | Kincel | 42/1.06 |
| 2011/0113665 | A1 * | 5/2011 | Cottle et al. | 42/73 |
| 2011/0131857 | A1 * | 6/2011 | Kuczynko et al. | 42/73 |
| 2011/0173863 | A1 * | 7/2011 | Ingram | 42/73 |
| 2011/0283584 | A1 * | 11/2011 | Walters | 42/73 |
| 2012/0000109 | A1 * | 1/2012 | Zusman | 42/71.01 |
| 2012/0023802 | A1 * | 2/2012 | Vesligai | 42/71.01 |
| 2012/0030983 | A1 * | 2/2012 | Kuczynko et al. | 42/73 |
| 2012/0180353 | A1 * | 7/2012 | Holmberg | 42/1.06 |
| 2012/0186124 | A1 * | 7/2012 | Kincel | 42/74 |
| 2012/0204464 | A1 * | 8/2012 | Kincel | 42/73 |
| 2013/0036645 | A1 | 2/2013 | Chvala | |
| 2013/0097911 | A1 * | 4/2013 | Larue | 42/73 |
| 2013/0180148 | A1 * | 7/2013 | Rogers et al. | 42/73 |
| 2014/0041518 | A1 * | 2/2014 | Neitzling | 89/191.01 |
| 2014/0075815 | A1 * | 3/2014 | Jarboe | 42/73 |

* cited by examiner

ADJUSTABLE STOCK FOR A FIREARM

BACKGROUND OF THE INVENTION

The present disclosure relates generally to firearms, and more particularly, pertains to a variably configurable firearm stock and cheek rest assembly for a firearm.

There has been a long-standing recognition as to the desirability of firearms in which the stock can be moved between various positions which provide the shooter with the desired length of pull for comfort and accurate shooting. The adjustable positioning of the stocks is useful during transport, storage and use of firearms, and is particularly advantageous in certain tactical situations. Sliding stocks are known to have a stock assembly in which a butt stock is slidably adjustable along a fixed support member between one or more collapsed and extended shoulder-engaging positions.

In addition to the length of the butt stock being adjustable, it is also important for the top portion of the butt stock, known as the cheek rest, to be adjustable. Cheek rests are known to be normally adjustable on butt stocks so as to quickly and comfortably provide a shooter with proper sight alignment.

Attempts have been made to advance the functionality of the stock and cheek rest assembly to include different adjustable configurations, but generally have been found not to be reliable and durable over repeated operation. Previous variably configurable stock and cheek rest assemblies have been unsatisfactory due to, among other things, numerous pieces or parts which can undesirably increase the weight of the assembly, problematic assembly and operation, expensive product costs and a susceptibility to dirt and grit encountered in the field which can negatively affect use.

Accordingly, there remains a need to provide a firearm stock and cheek rest assembly which incorporates, in one integrated design, an enhanced adjustable shoulder and cheek engaging structure which overcomes the shortcomings of previous designs.

SUMMARY OF THE INVENTION

The present disclosure relates to an adjustable stock and cheek rest assembly for a firearm which includes a support member connected to the firearm and provided with lock receiving structure thereon, and a stock slidably mounted on the support member. A cheek rest is disposed in overlying relationship to the stock. A cheek rest adjustment arrangement is connected between the stock and the cheek rest, and provided with a movable linkage for enabling vertical adjustment of the cheek rest relative to the stock. A movable member is provided with locking structure and is mounted on the stock for selective engagement with the lock receiving structure for locking the stock and the cheek rest in various axial adjustment positions along the support member.

In an exemplary embodiment, the movable linkage is an expandable and collapsible scissors linkage. The cheek rest adjustment arrangement includes an adjustment device, and the linkage is movable in response to actuation of the adjustment device. The adjustment device enables incremental adjustment and locking of the cheek rest relative to the stock. The adjustment device is rotatable and includes a cheek wheel coupled to a lift pin operably connected to the linkage. The cheek rest adjustment arrangement also includes a lift rod located between the cheek wheel and the lift pin. The support member is a buffer tube extending rearwardly from the firearm. The lock receiving structure is a series of spaced apart cylindrical recesses formed in a bottom surface of the buffer tube. The stock is provided with a butt pad assembly at a rearward end thereof. The movable member includes a lever connected to a spring biased latch pin with a cylindrical portion that is engageable and disengageable with the cylindrical recesses on the buffer tube.

The present disclosure also relates to an adjustable stock and cheek rest assembly for a firearm and includes a buffer tube extending rearwardly from the firearm and including a series of recesses formed in a bottom surface thereof. A stock has one end slidably mounted for axial movement on the buffer tube, and an opposite end provided with a butt pad assembly. A cheek rest is disposed in overlying relationship to the stock. A cheek rest adjustment arrangement is connected between the stock and the cheek rest, and provided with an expandable and collapsible scissor linkage which is movable in response to a movable adjustment device for enabling vertical adjustment of the cheek rest relative to the stock. A lever arrangement is movably mounted on the stock and is provided with a spring biased latch pin which is selectively engageable and disengageable with any one of the recesses on the buffer tube for locking the stock, the cheek rest, the butt pad assembly and the lever arrangement in various axial adjustment positions along the buffer tube.

Rotation of the adjustment device results in incremental adjustment and locking of the cheek rest relative to the stock. The linkage includes a set of outer lift links and an inner lift link operably coupled together to the stock and the cheek rest by a pivot pin arrangement. The cheek rest adjustment arrangement also includes a cheek base attached to the cheek rest, and a lift base secured to the stock. The cheek base and the lift base include hole and slot structure for receiving the pivot pin arrangement. A spring biased detent member is positioned between the cheek base and the adjustment device. The cheek rest adjustment arrangement also includes a lift pin threadably coupled to the adjustment device. The adjustment device includes a rotatable cheek wheel attached to a lift rod which is threadably engaged with the lift pin. Rotation of the cheek wheel and the lift rod causes movement of the lift pin, and results in movement of the scissors linkage and the cheek rest relative to the stock. The adjustment device is accessible for movement between a rearward end of the cheek rest and the butt pad assembly.

BRIEF DESCRIPTION OF THE DRAWINGS

The drawings illustrate the best mode presently contemplated in carrying out the disclosure. In the drawings.

DETAILED DESCRIPTION

Figure 1:
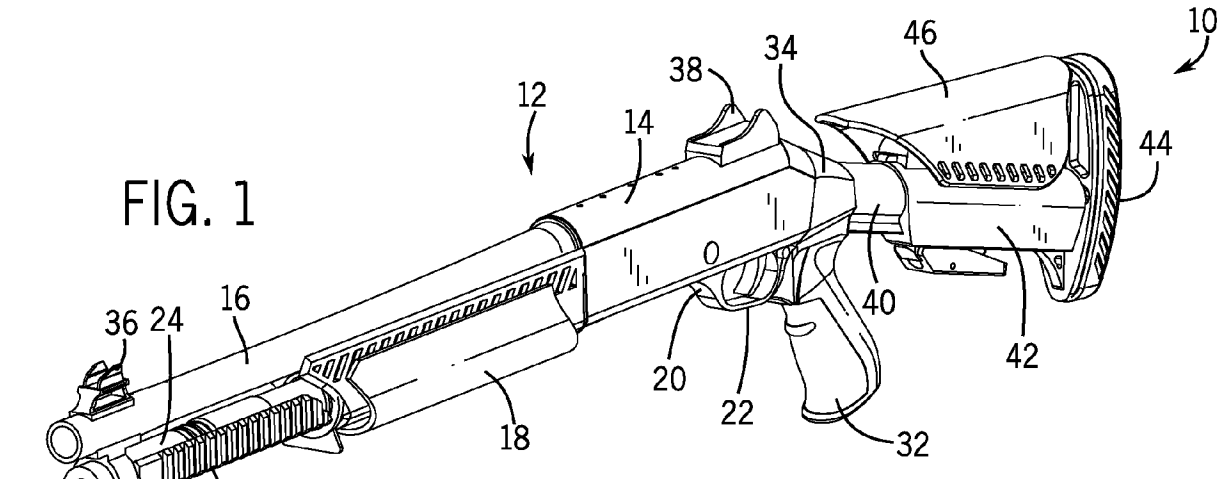
FIGS. 1 and 2 are perspective views of a shotgun provided with an adjustable stock and cheek rest assembly.
Figure 2:
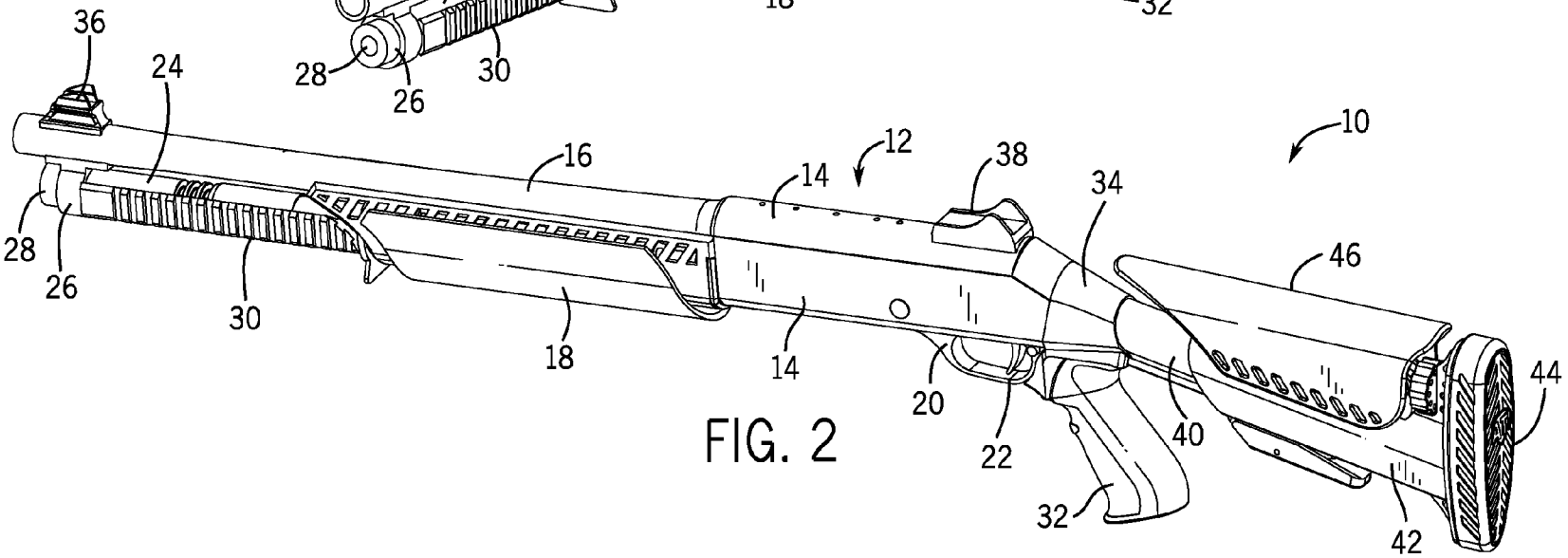

Referring now to the drawings. FIGS. 1 and 2 illustrate an adjustable stock and cheek rest assembly 10 movably attached relative to a rear portion of a firearm, such as a semi-automatic shotgun 12.

Shotgun 12 typically includes a receiver 14, a barrel 16, a gripping forend 18, a trigger guard 20 and a trigger 22. The shotgun 12 shown also includes a cartridge-storing magazine tube 24 that extends longitudinally forward from the receiver 14 and below the barrel 16. A forward portion of the magazine tube 24 engages a barrel lug 26 and is held thereto by a magazine cap 28. An accessory mounting rail 30 is provided alongside magazine tube 24. In addition, shotgun 12 is provided with a pistol grip assembly formed by a pistol grip 32 and a mounting device 34 connected below and at the rear of receiver 14. A forward sight 36 is located adjacent to an outer, upper end of barrel 16, and a rearward sight 38 is positioned on a back, upper end of receiver 14.

In accordance with the present disclosure, the adjustable stock and cheek rest assembly 10 is generally comprised of a stationary stock support or buffer tube 40 extending rearwardly and downwardly from the receiver 14 and passing through the mounting device 34, a stock 42 adjustably mounted for sliding movement on the buffer tube 40, a butt pad assembly 44 secured on a rear end of the stock 42 and an adjustable cheek rest 46 movably mounted on the stock 42. As will be further explained below, the adjustable stock and cheek rest assembly 10 also includes a cheek rest adjustment arrangement for variable height adjustment of the cheek rest 46 relative to the stock 42, and an incremental telescopic or sliding stock adjustment arrangement for selectively adjusting the axial position of the stock 42, the butt pad assembly 44 and the cheek rest 46 relative to the buffer tube 40.

Figure 3:
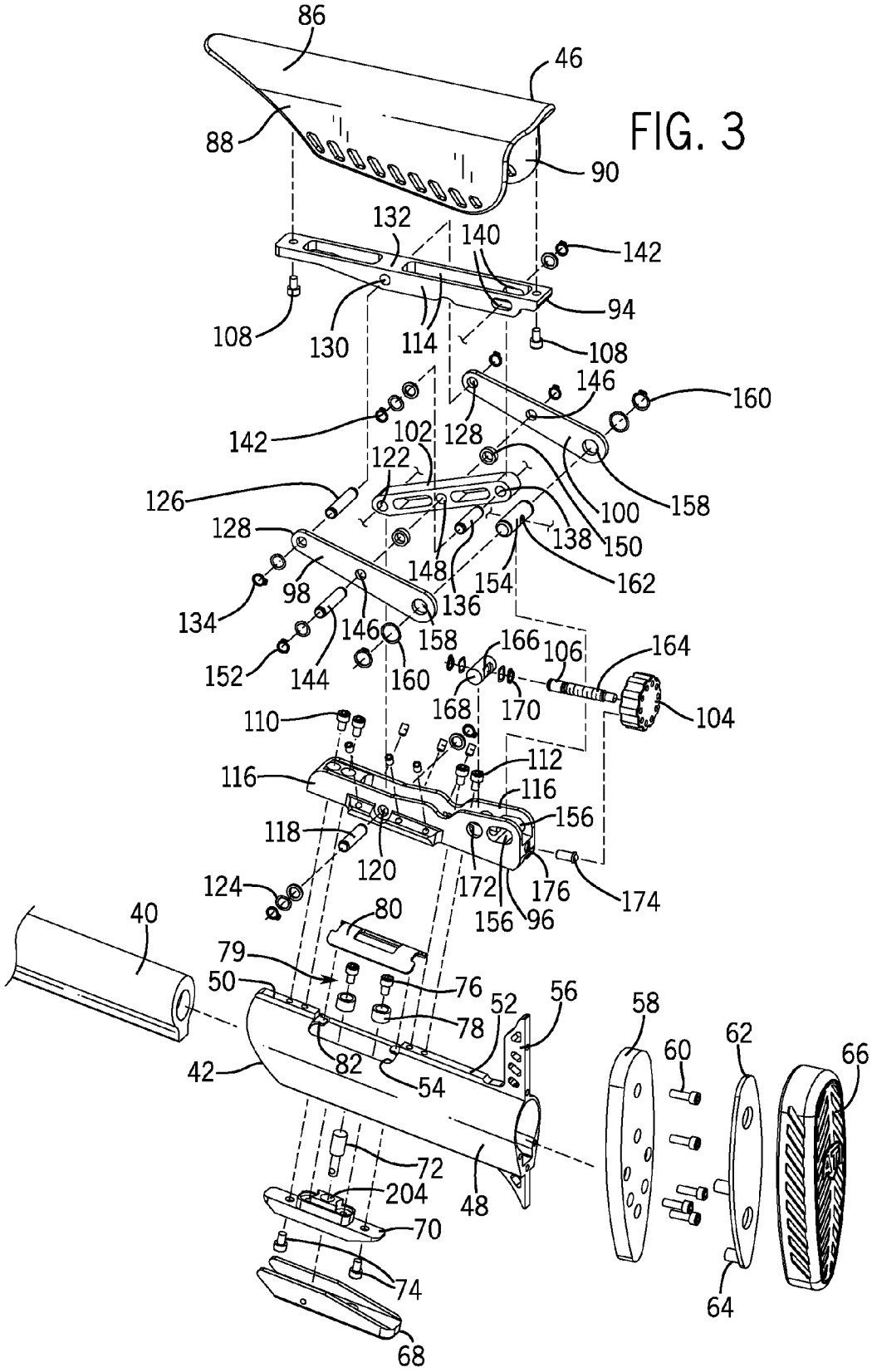
FIGS. 3 and 4 are exploded of various components defining the adjustable stock and cheek rest assembly.
Figure 4:
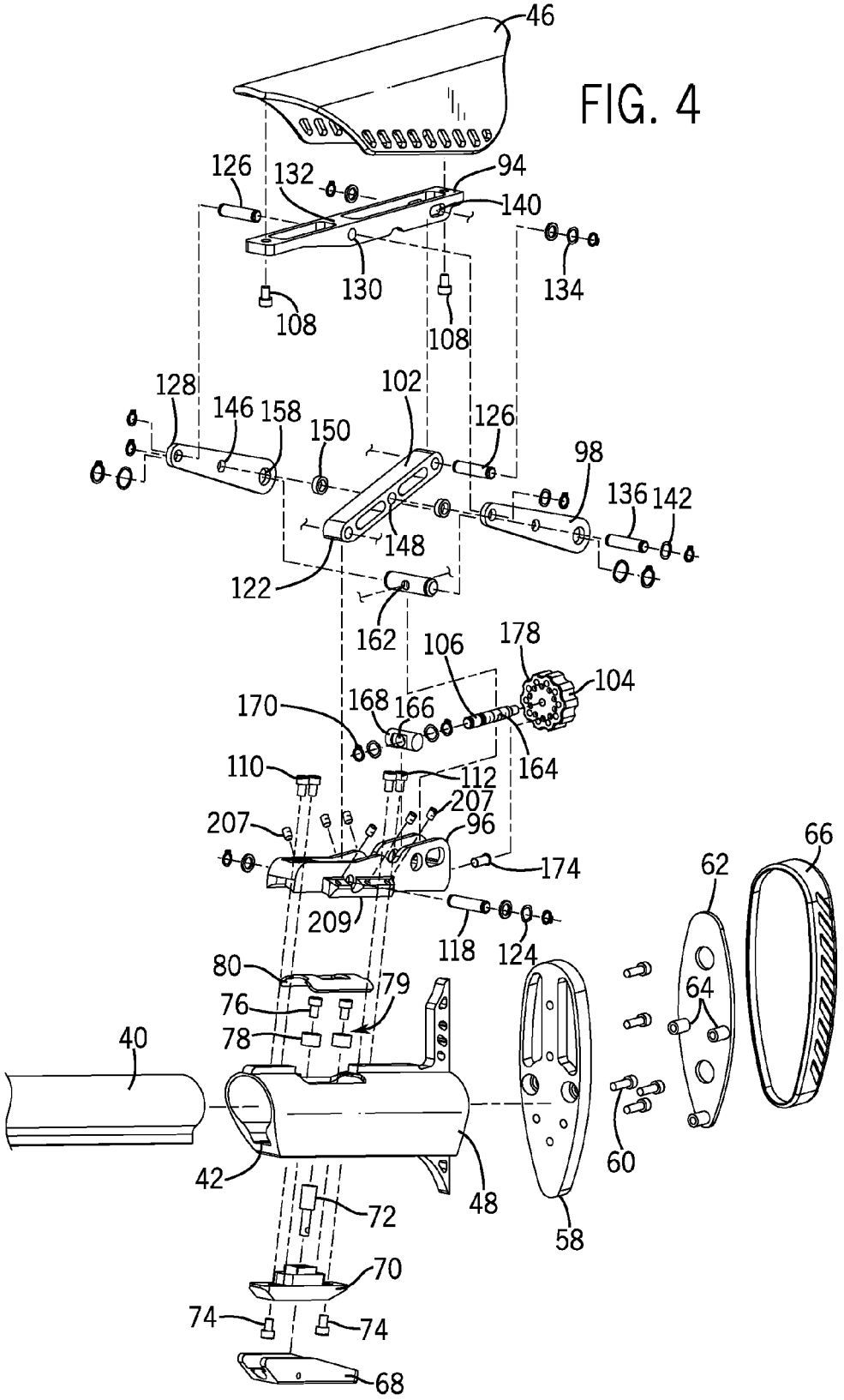

Referring now to FIGS. 3 and 4, the stock 42 has a tubular body 48 with open front and rear ends designed to be slidably mounted on an outer surface of the buffer tube 40. The stock body 48 has front and rear mounting rails 50, 52, respectively, provided on either side of an upper opening 54, and a vertically extending mounting fin 56 at the rear end. The butt pad assembly 44 includes a butt plate 58 which is secured to walls of various apertures formed on the mounting fin 56 and the rear end of the stock body 48 by fasteners 60. The butt pad assembly 44 further includes a butt pad insert 62 coupled frictionally by projections 64 to butt plate 62, and a butt pad 66 which is attached to the butt plate 62 and is adapted to engage the shoulder of the shooter during use of the shotgun 12 as is well known. A lever 68, a lever base 70 and a latch pin 72 together form a lever arrangement which is designed to be mounted at the bottom of the stock body 48 for movement therewith using fasteners 74. The lever 68, lever base 70 and the latch pin 72 are used to selectively engage the understructure of buffer tube 40 to establish positioning the stock 42 in different positions along a longitudinal axis of the buffer tube 40 as will be further explained below. A curved apertured plate 80 is supported by tabs 82 on the top of the stock 42 over opening 54.

A tension device, shown by reference numeral 79 in FIGS. 3 and 4, is positioned between the body 48 and the buffer tube 40 to control the fit between the components during relative movement. As most clearly shown in FIG. 5, the tension device 79 includes a pair of fasteners 76 and a pair of resilient bumpers 78. The fasteners 76 pass through the bumpers 78 to hold the bumpers 78 securely within the stock 42.

The adjustable cheek rest 46 has a top wall 86 and depending sidewalls 88, 90 which form a saddle-shaped body designed to overlie the stock 42. An outer surface of the cheek rest 46 can be provided with a soft surface to comfortably cushion the cheek of the shooter during use of the shotgun 12.

The cheek rest adjustment arrangement 92 is located between the stock 42 and the cheek rest 46 for providing height or vertical adjustment of the cheek rest 46 relative to the stock 42.

The cheek rest adjustment assembly 92 generally includes a cheek base 94, a lift base 96 and a set of cooperating outer lift links 98, 100, and a central or inner lift link 102 which are interconnected together to form an expandable and collapsible scissors linkage. The cheek rest adjustment arrangement includes an adjustment device defined by a cheek wheel 104 and a lift rod 106 which are joined together and operably coupled to the scissors linkage. As will be appreciated hereafter, the scissors linkage is expanded and collapsed to control height adjustment of the cheek rest 46 relative to the stock 42 in response to rotational movement of the adjustment device 104, 106.

Figure 6:
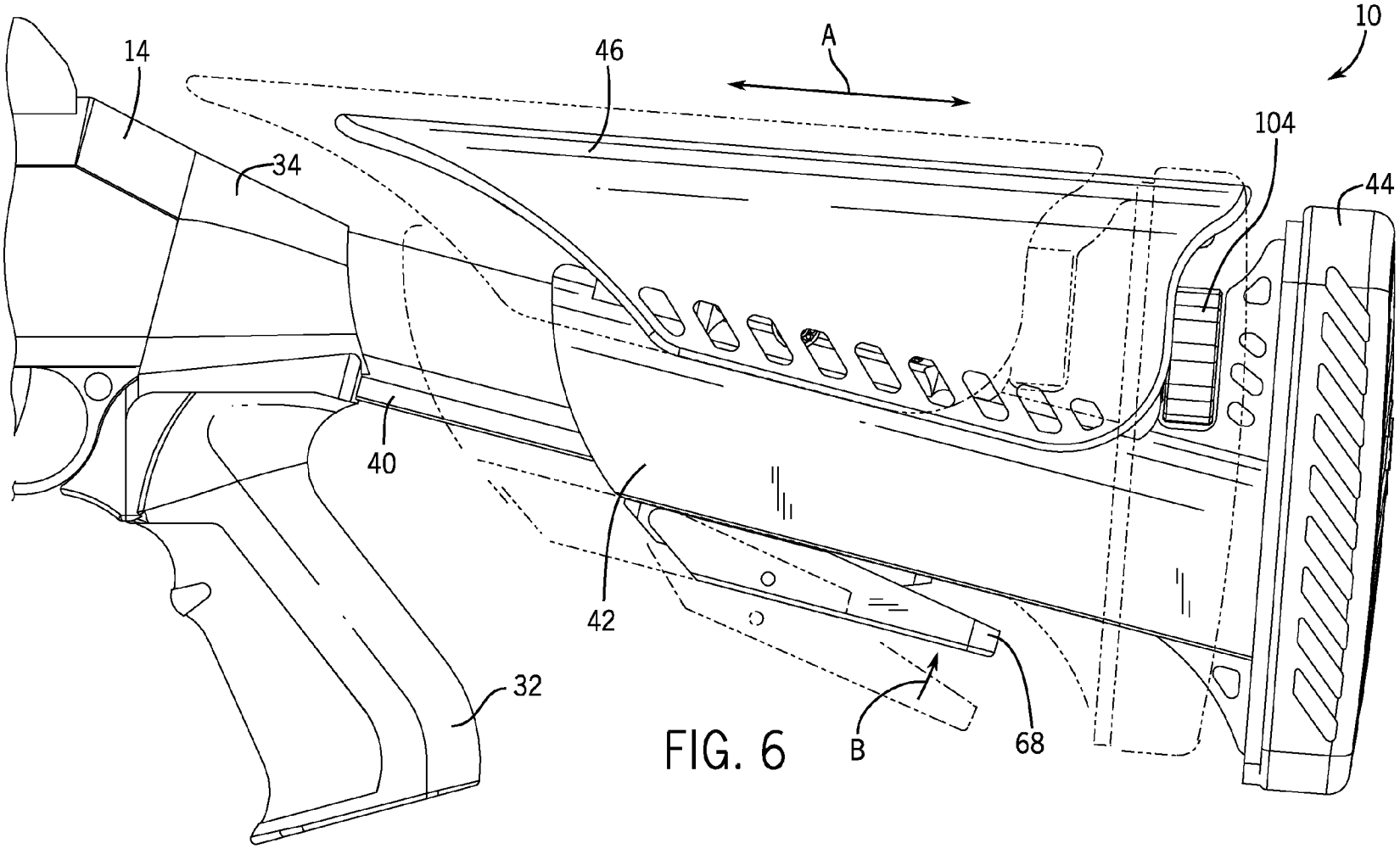
FIG. 6 is an enlarged elevational view of the assembled adjustable stock and cheek rest assembly illustrated in FIGS. 1 and 2, showing various adjustment positions of the stock and cheek rest assembly along a buffer tube of the firearm in solid and dotted lines.
Figure 7:
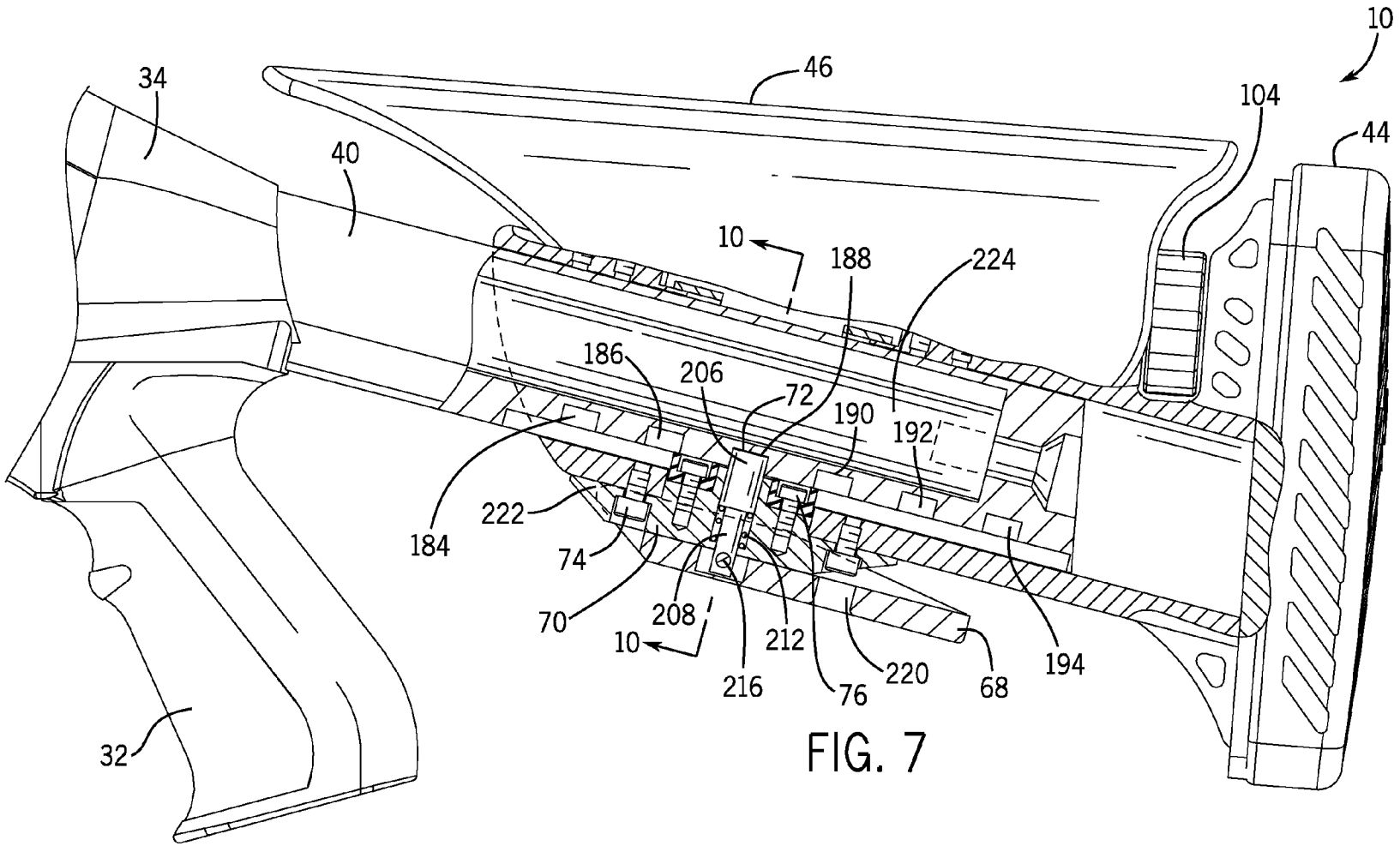
FIG. 7 is a partial sectional view of FIG. 6.

With further reference to FIGS. 6 and 7, forward and rearward ends of the cheek base 94 are fixedly attached to an underside of cheek rest top wall 86 and between sidewalls 88, 90 by fasteners 108. The lift base 96 has forward and rearward ends secured to the mounting rails 50, 52 of stock 42 by fasteners 110, 112. The cheek base 94 and the lift base 96 have spaced apart sidewalls 114, 116, respectively, variously configured with aligned throughholes and slots to facilitate a pivotal attachment of the lift links 98, 100, 102 thereto via a set of pivot and lift pins. Outer lift links 98, 100 are pivotally mounted outside the sidewalls 114, 116, while inner lift link 102 is pivotally mounted within the sidewalls 114, 116.

The pivotal mounting includes a first pivot pin 118 that passes through aligned holes 120 in lift base 96, and through a hole 122 on a forward end of inner link 102. The pin 118 is held in place by retainers 124.

A second pivot pin 126 is received through aligned holes 128 and forward ends of the outer links 98, 100 and a throughole 130 formed through a medical portion 132 of the cheek base 94. The pin 126 is held in place by retainers 134.

A third pivot pin 136 passes through a hole 138 in a rear end of inner link 102, and aligned slots 140 formed in a rearward end of the cheek base 94. The pin 136 is designed to move back and forth in the slots 140 during height adjustment of cheek rest 46. The pin 136 is held in place by retainers 142.

A fourth pivot pin 144 is received through aligned holes 146 in center portions of outer links 98, 100, and a center hole 148 in inner link 102. The pin 144 also passes through a pair of spacers 150 positioned between outer side surfaces of inner link 102 and inner side surfaces of outer links 98, 100. The pin 144 is held in place by retainers 152.

A lift pin 154 extends through aligned slots 156 formed in a rearward end of the lift base 96, and through aligned holes 158 formed in rearward ends of the outer links 98, 100. The pin 154 is designed to move back and forth in the slots 156 during height adjustment of the cheek rest 46. The lift pin 154 is held in place by retainers 160.

The lift pin 154 has a threaded hole 162 formed transversely therethrough which receives a threaded portion 164 on the lift rod 106 that is fixed to the cheek wheel 104 for rotation therewith. The cheek wheel 104 is accessible for movement outside the rearward end of the lift base 96, and between a rearward end of the cheek rest 46 and the butt pad assembly 44. An outer end of the lift rod 106 is received in a hole 166 formed transversely through an anchor pin 168, and held in place by retainers 170. Outer ends of the anchor pin 168 are engaged with walls forming aligned holes 172 towards the rearward end of the lift base 96. A spring biased detent pin 174 is received in a recess 176 at the rear of the lift base 96 and has a ball-shaped head biased into locking engagement with one of the mating recesses 178 formed in a face of the cheek wheel 104.

As more fully explained in pending U.S. patent application Ser. No. 13/832,568, filed Mar. 15, 2013, rotation of the cheek wheel 104 and the lift rod 106 causes movement of the lift pin 154, and results in movement of the scissors linkage 98, 100, 102 and the cheek rest 46 relative to the stock 42 so that the cheek rest 46 can be incrementally adjusted vertically relative to the stock 42. Rotation of the cheek wheel 104 and the lift rod 106 also results in locking of the cheek rest 46 relative to the stock 42 due to the engagement of spring biased pin 174 with the recesses 178.

Figure 5:
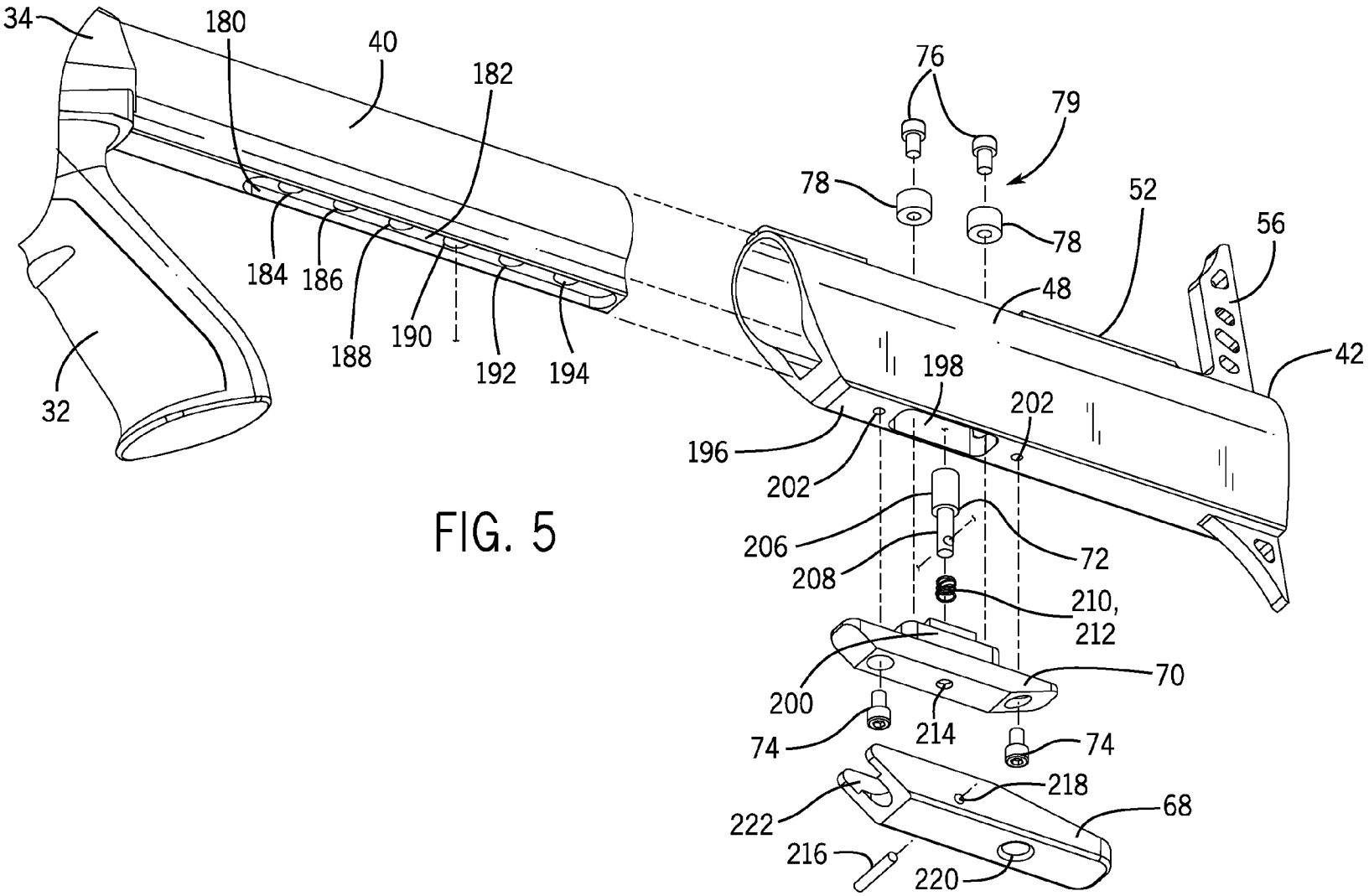
FIG. 5 is an enlarged exploded view of an adjustable stock assembly shown in FIGS. 3 and 4.

Referring to FIG. 5, an underside of the buffer tube 40 is provided with a channel 180 exposing a flat surface 182 formed with a lock receiving structure. The lock receiving structure is defined by a series of spaced apart, cylindrical, latch pin receiving recesses 184, 186, 188, 190, 192, 194 which serve to establish different axial positions for the sliding stock 42, the butt pad assembly 44 and the cheek rest 46 along the buffer tube 40 as will be more fully understood hereafter.

The stock body 48 has a bottom surface 196 formed with a lower opening 198 which is aligned with the upper opening 54 in body 48. The aligned openings 54, 198 enable the attachment of the fasteners 76 and bumpers 78 to an upper section 200 of the lever base 70 which is received in the lower opening 198. The lever base 70 is also attached by the fasteners 74 to holes 202 formed in the bottom surface 196 of stock body 48. The latch pin 72 defines a locking structure, and is designed to be received in a central aperture 204 (FIG. 3) provided in the upper section 200. The latch pin 72 includes an upper cylindrical portion 206, and a lower cylindrical portion 208 having a reduced diameter compared to upper portion 206.

Figure 8:
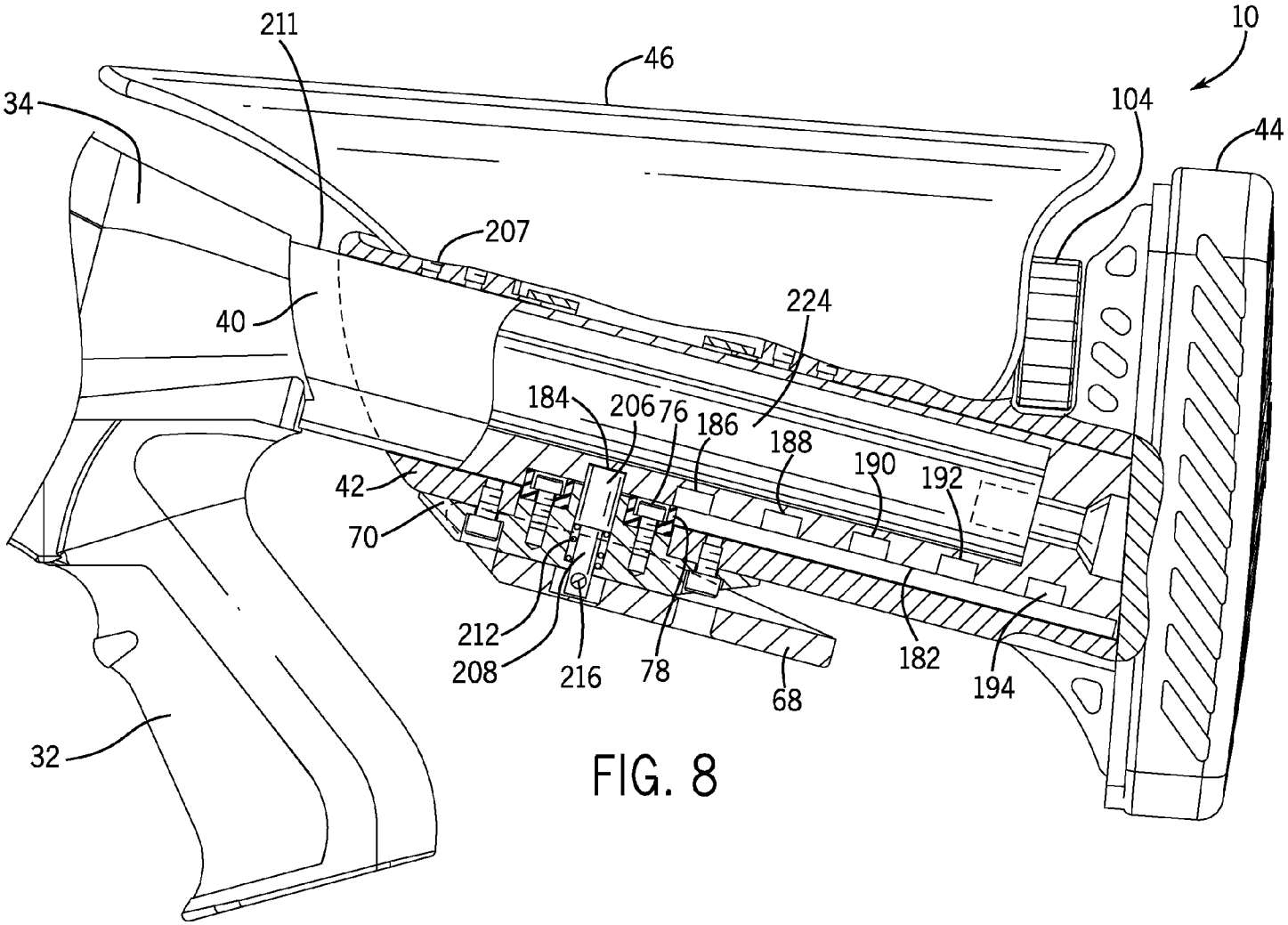
FIG. 8 is a view similar to FIG. 7 illustrating the stock and cheek rest assembly adjusted to a position forwardly on the buffer tube from that shown in FIG. 7.

As can be understood in FIGS. 5 and 8, each of the bumpers 78 includes an outer surface that contacts the flat surface 182 formed within the channel 180 in the bottom of the buffer tube 40. In the embodiment illustrated, each of the bumpers 78 is formed from a resilient material that creates a source of friction between the stock 42 and the buffer tube 40.

As best illustrated in FIG. 4, the lift base 96 includes a series of set screws 207 that each are received within a mounting block 209.

As illustrated in FIG. 8, each of the set screws 207 can be adjusted to contact the outer surface 211 of the buffer tube 40. The rotation of each of the set screws 207 helps increase or decrease the friction force between the bumpers 78 and the flat surface 182. In this manner, the user can selectively adjust the friction fit between the stock 42 and the buffer tube 40.

As can be understood in FIG. 8, before the set screws 207 can be adjusted, the cheek rest 46 is removed to allow the user access to each of the set screws 207. Once the set screws have been adjusted, the cheek rest 46 is returned to the position shown in FIG. 8. The use of the tensioning device, including the fasteners 76, bumpers 78 and set screws 207, can either increase or decrease the frictional interference fit between the buffer tube 40 and the stock 42. In this manner, the user can adjust the fit between the two sliding components of the adjustable stock and check rest assembly 10.

Figure 10:
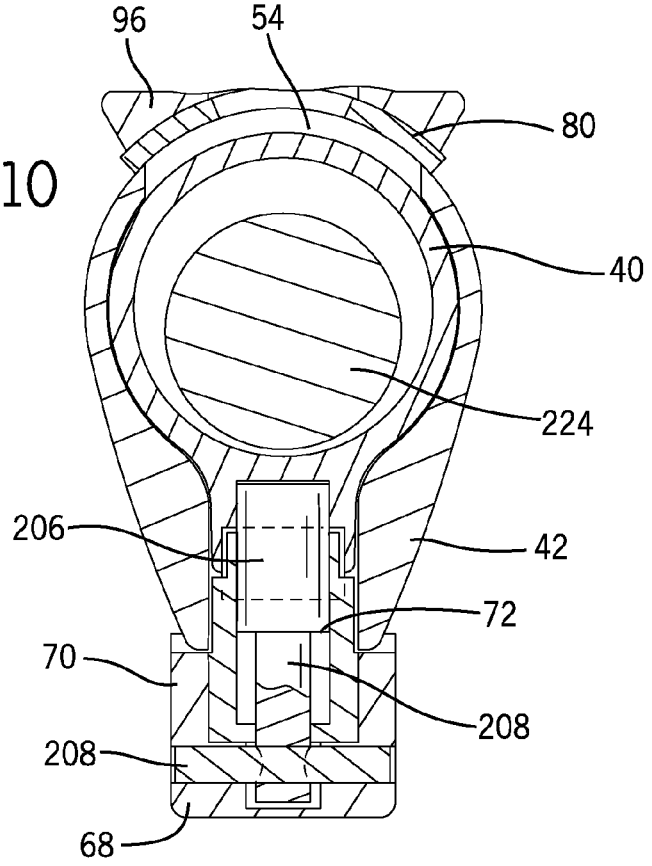
FIG. 10 is an enlarged sectional view taken on line 10-10 of FIG. 7.

Upper cylindrical portion 206 is designed to lockingly engage with walls of the buffer tube recesses 184, 186, 188, 190, 192, 194. Lower cylindrical portion 208 is provided with a throughole 210 and is surrounded by a spring 212 which is received in the central aperture 204 of lever base 70. The lower cylindrical portion 208 of latch pin 72 projects through a hole 214 in lever base 70, and is received in a recess formed in the bottom of lever 68. A retaining pin 216 is passed through holes 218 provided in sidewalls of the lever 68 and the throughole 210 to hold the latch pin 72 and the lever 68 together in a normally upwardly biased position such as depicted in FIGS. 7 and 8. Lever 68 and the spring biased latch pin 72 permit stock 42, the butt pad assembly 44 and the cheek rest 46 to be selectively locked and released for repositioning along the buffer tube 40. Lever 68 is provided with a throughole 220 and a cutaway portion 222 to enable access to the fasteners 74. As seen in FIGS. 7, 8 and 10, the buffer tube 40 surrounds a gas tube 224 of the firearm receiver.

FIGS. 6-8 illustrate the stock and cheek rest assembly 10 with the stock 42, the butt pad assembly 44 and the cheek rest 46 as well as lever 68 adjustably and slidably mounted axially on the buffer tube 40. As shown in FIG. 8, the buffer tube 40 is mounted to surround the gas tube 224 that forms part of the receiver of the firearm. The gas tube 224 extends downwardly at an angle relative to the receiver. In the embodiment illustrated, the gas tube 224 extends at approximately a 45 degree angle relative to the receiver. The buffer tube 40 is mounted to and surrounds the gas tube 224.

FIG. 6 shows the stock 42, the butt pad assembly 44, and the cheek rest assembly 46 locked in one axial position as shown in solid lines, and released to slide the components 42, 44 and 46 to another axial position as shown in dotted lines. The stock 42, the butt pad assembly 44 and the cheek rest 46, as well as the lever 68, are slidably adjustable together back and forth on buffer tube 40 as represented by double ended arrow A. As can be understood in FIG. 6, since the buffer tube 40 extends downwardly at an angle relative to the receiver 14, movement of the stock 42 along the buffer tube 40 causes the cheek rest 46 to rise and fall. Typically, the gas tube surrounded by the buffer tube 40 extends at an angle of approximately 45° relative to the receiver 14.

As seen in FIG. 7, the spring 212 functions to normally bias the upper portion 206 of latch pin 72 in locking engagement with the walls forming a selected recess, such as recess 188, and thereby establishes a desired setting or partially extended position of the stock 42, butt pad assembly 44 and cheek rest 46 on the buffer tube 40.

Figure 9:
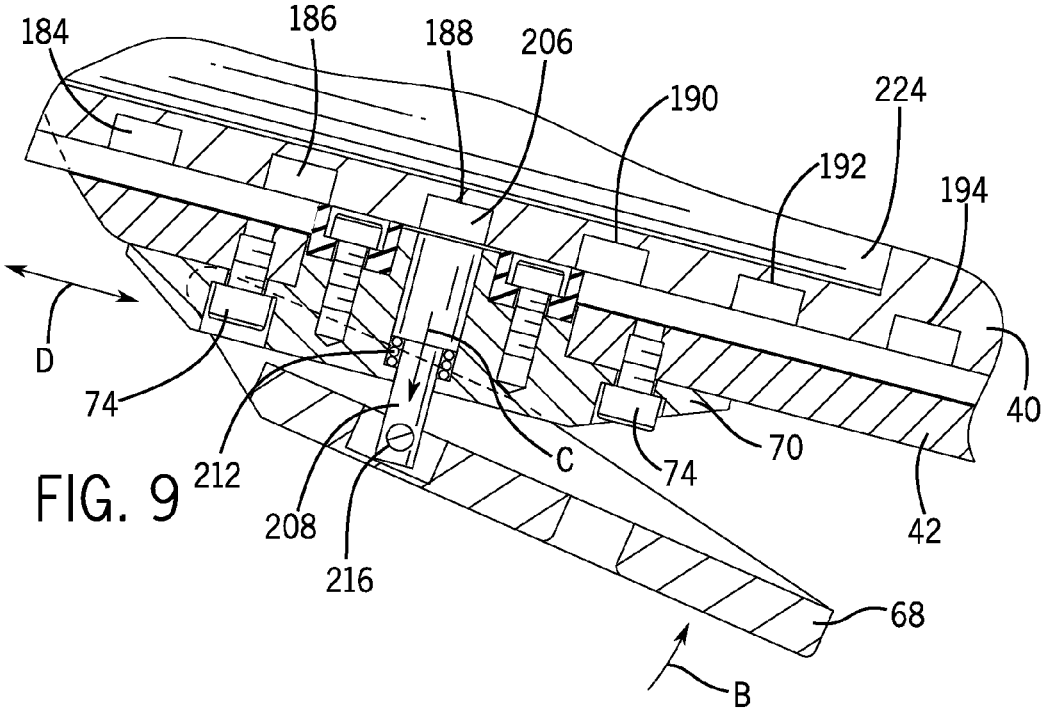
FIG. 9 is an enlarged sectional view of an adjustment lever arrangement used in adjusting the stock and cheek rest assembly on the buffer tube.

Should it become desirable to adjust the axial position of the stock 42, the butt pad assembly 44 and the cheek rest 46 on buffer tube 40, the user depresses the lever 68 upwardly in the direction of arrow B shown in FIGS. 6 and 9. This action pulls the latch pin 72 downwardly (as shown by arrow C) compressing the spring 212 and releasing the upper portion 206 of latch pin 72 from walls of recess 188. The user is then free to slide the entire stock assembly including lever 68 back and forth in directions represented by double ended arrow D in FIG. 9. For example, the user may then slide the stock 42, the butt pad assembly 44 and the cheek rest 46 forwardly to the axial position shown in FIG. 8. Releasing the lever 68 will enable the spring 212 to return the upper portion 208 of latch pin 72 into locking engagement with the walls of newly selected recess 184 on buffer tube 40. If desired, continuous downward pressure on lever 68 will enable the stock 42, butt pad assembly 44, cheek rest 46 and lever 68 to be slidably removed from the buffer tube 40. Although six recesses 184, 186, 188, 190, 192, 194 are shown illustrating six discrete adjustment positions, it should be understood that any number of recesses could be provided to define any desired number of adjustment positions.

As should be appreciated, the sliding adjustment of the stock 42, the butt pad assembly 44, the cheek rest 46 and the lever 68 relative to the buffer tube 40 permits users with a range of arm lengths to hold the shotgun 12 comfortably against their shoulder regardless of the length of their arms, or the type or amount of clothing or protective gear worn at the time of shotgun use in the shoulder area. Since the stock 42 moves along the angled buffer tube 40, adjustment of the stock causes the height of the cheek rest 46 to change relative to the receiver. For this reason, the adjustability of the cheek rest 46 is particularly desirable. It should be further appreciated that the cheek rest 46 can be adjusted as desired to attain the proper sight alignment using the sliding stock adjustment arrangement and/or the cheek rest adjustment arrangement 92.

Various alternatives are contemplated as being within the scope of the following claims particularly pointing and distinctly claiming the subject matter regarded as the invention.

I claim:

1. An adjustable stock and cheek rest assembly for a firearm comprising:

a support member connected to the firearm and provided with lock receiving structure thereon;

a stock slidably mounted on the support member;

a cheek rest disposed in overlying relationship to the stock;

a cheek rest adjustment arrangement connected between the stock and the cheek rest, and for selectively adjusting a position of the cheek rest in a substantially vertical direction relative to the stock; and a movable member provided with locking structure and mounted on the stock for selective engagement with the lock receiving structure for locking the stock and the cheek rest in various axial adjustment positions along the support member, wherein the cheek rest adjustment arrangement includes a cheek base attached to the cheek rest, a lift base fixed to the stock, an expandable and collapsible scissors linkage connected between the cheek base and the lift base, and a rotatable adjustment device coupled to the expandable and collapsible linkage and formed with a cheek wheel attached to a lift rod having a threaded portion, wherein the lift base includes a forward end, a rearward end and a pair of spaced apart vertical sidewalls being formed with a first pair of aligned holes towards the forward end thereof, a second pair of aligned holes towards the rearward end thereof, and a pair of aligned slots located rearwardly of the second air of aligned holes, wherein the scissors linkage includes a pair of outer lift links coupled to an inner lift link, the outer and inner lift links having respective forward ends and rearward ends pivotally connected directly to the cheek base and the lift base by a pin arrangement, wherein the pin arrangement includes a lift pin which extends through the aligned slots formed in the rearward end of the lift base, and through aligned holes formed in the rearward ends of the outer lift links, the lift pin being configured to be movable within the aligned slots in the lift base during adjustment of the position of the cheek rest, the lift pin being formed transversely therethrough with a threaded hole which directly receives the threaded portion of the lift rod, and wherein rotation of the cheek wheel and the lift rod causes movement of the lift pin within the aligned slots formed in the rearward end of the lift base resulting in the rearward ends of the outer lift links pivoting about the lift pin and subsequent movement of the scissors linkage and the cheek rest relative to the stock.

2. The adjustable stock and cheek rest assembly of claim 1, wherein the support member is a buffer tube extending rearwardly from the firearm.

3. The adjustable stock and cheek rest assembly of claim 2, wherein the lock receiving structure is a series of spaced apart cylindrical recesses formed in a bottom surface of the buffer tube.

4. The adjustable stock and cheek rest assembly of claim 1, wherein the stock is provided with a butt pad assembly at a rearward end thereof.

5. The adjustable stock and cheek rest assembly of claim 3, wherein the movable member includes a lever connected to a spring biased latch pin with a cylindrical portion that is engageable and disengageable with the cylindrical recesses on the buffer tube.

6. An adjustable stock for a firearm having a receiver comprising:

a buffer tube extending rearwardly from the receiver and including a series of recesses formed in a bottom surface thereof;

a stock having one end slidably mounted for axial movement along the buffer tube and an opposite end provided with a butt pad assembly;

a lever arrangement movably mounted on the stock to selectively engage and disengage with any one of the recesses on the buffer tube for locking the stock in various axial adjustment positions along the buffer tube; and a resilient tension device positioned between the stock and the buffer tube and secured within the lever arrangement to form and selectively adjust an interference fit between the buffer tube and the stock during relative sliding movement therebetween.

7. The adjustable stock of claim 6 wherein the tension device is mounted within the stock and frictionally engages the buffer tube.

8. The adjustable stock of claim 6 further comprising a cheek rest disposed in an overlying relationship to the stock and a cheek rest adiustment arrangement connected between the stock and the cheek rest.

9. The adjustable stock of claim 8 wherein the cheek rest is adjustable independent of the movement of the stock along the buffer tube.

10. The adjustable stock of claim 6 wherein the tension device is adjustable prior to mounting of the stock along the buffer tube.

11. The adjustable stock of claim 6 wherein the tension device includes a set of fasteners passing through a set of resilient bumpers.

12. The adjustable stock of claim 8 further including a set screw tension device connected between the cheek rest adjustment device and the buffer tube.

13. The adjustable stock and cheek rest assembly of claim 1, wherein a spring biased detent member is positioned between the cheek base and the rotatable adjustment device.

14. The adjustable stock and cheek rest assembly of claim 13, wherein the adjustment device is provided with a series of recesses which are variously engageable with the spring biased detent member.

15. The adjustable stock and cheek rest assembly of claim 1, wherein the adjustment device is accessible at a rearward end of the lift base.

16. The adjustable stock and cheek rest assembly of claim 1, wherein the cheek base includes a forward end, a rearward end and a pair of vertical spaced apart sidewalls being formed with a throughhole medially therethrough, and a pair of aligned slots in the rearward end thereof.

17. The adjustable stock and cheek rest assembly of claim 1, wherein the lift rod has an outer end which is received in a hole formed transversely in an anchor pin retained in the second pair of aligned holes formed in the sidewalls of the lift base.

18. The adjustable stock and cheek rest assembly of claim 1, wherein the outer lift links are pivotally mounted outside the sidewalls of the lift base and the cheek base, and the inner lift link is pivotally mounted within the sidewalls of the lift base and the cheek base.

19. The adjustable stock and cheek rest assembly of claim 1, wherein the cheek wheel is positioned between the rearward end of the lift base and a rearward end of the stock.

* * * * *